US006373199B1

(12) United States Patent
Erhardt et al.

(10) Patent No.: US 6,373,199 B1
(45) Date of Patent: Apr. 16, 2002

(54) REDUCING STRESS ON IGNITOR CIRCUITRY FOR GASEOUS DISCHARGE LAMPS

(75) Inventors: Robert Erhardt, Schaumburg, IL (US); Oscar Deurloo, Rosmalen (NL)

(73) Assignee: Philips Electronics North America Corporation, New York, NY (US)

( * ) Notice: Subject to any disclaimer, the term of this patent is extended or adjusted under 35 U.S.C. 154(b) by 0 days.

(21) Appl. No.: 09/548,113

(22) Filed: Apr. 12, 2000

(51) Int. Cl.[7] ..... H05B 37/00

(52) U.S. Cl. ..... 315/289; 315/291; 315/307; 315/209 R

(58) Field of Search ..... 315/289, 291, 315/307, 209 R, 224, 274, 276, DIG. 7, 209 M, 214

(56) References Cited

U.S. PATENT DOCUMENTS

| | | | | |
|---|---|---|---|---|
| 5,047,694 A | * | 9/1991 | Nuckolls et al. | 315/290 |
| 5,132,870 A | | 7/1992 | Droho | 361/377 |
| 5,319,286 A | | 6/1994 | Leyten | 315/289 |
| 5,572,093 A | * | 11/1996 | Keifer | 315/289 |
| 5,801,494 A | * | 9/1998 | Herres et al. | 315/289 |
| 5,825,139 A | | 10/1998 | Nuckolls et al. | 315/307 |
| 6,008,591 A | | 12/1999 | Huber et al. | 315/219 |
| 6,091,208 A | * | 7/2000 | Flory, IV | 315/290 |
| 6,144,171 A | * | 11/2000 | Clements et al. | 315/289 |
| 6,204,611 B1 | * | 3/2001 | Bouwman et al. | 315/290 |

FOREIGN PATENT DOCUMENTS

| | | |
|---|---|---|
| DE | 3704441 A1 | 10/1997 |
| EP | 0405715 A1 | 4/1990 |

OTHER PUBLICATIONS

"Ignitor for High Intensity Discharge Lamp", specification for attorney docket number PHA 23,680, U.S. Serial No. 09/316,983, filed May 24, 1999.

* cited by examiner

*Primary Examiner*—Don Wong
*Assistant Examiner*—Ephrem Alemu

(57) ABSTRACT

Igniter circuitry for a gaseous discharge lamp includes an inductive igniting pulse generating circuit and a capacitive timing circuit. The pulse generating circuit includes a unidirectional voltage-sensitive switch which is electrically connected in series with a capacitor in the timing circuit to unidirectionally limit common current.

10 Claims, 6 Drawing Sheets

REDUCING STRESS ON IGNITOR CIRCUITRY FOR GASEOUS DISCHARGE LAMPS

BACKGROUND OF THE INVENTION

1. Field of the Invention

This invention relates to gaseous discharge lamps which ignite at voltages that are much higher than their operating voltages and, in particular, to the igniting of such lamps.

2. Description of Related Art

Common characteristics of a gaseous discharge lamp are its negative resistance and high igniting voltage. A circuit arrangement for powering such a lamp typically includes a current limiting means, such as a ballast, to compensate for the negative resistance, and often includes igniter circuitry for generating high-voltage pulses to ignite the lamps. Such igniter circuitry commonly includes a voltage-sensitive switch (e.g. a sidac) for effecting the continual production of the high-voltage pulses until the lamp ignites. Upon ignition, the voltage across the lamp decreases from a higher open-circuit voltage (OCV) to a lower voltage, which causes the switch to change to a non-conducting state and to effect termination of pulse production. One example of such a ballast is described in U.S. Pat. No. 5,319,286.

In some situations, the igniter circuitry may be over-stressed to the point where the voltage-sensitive switch fails. This is particularly a problem with igniter circuitry which repeatedly applies such high-voltage pulses to a lamp which cannot be stably ignited.

SUMMARY OF THE INVENTION

It is an object of the invention to provide circuitry for igniting a gaseous discharge lamp which reduces stress on the voltage-sensitive switch during generation of the igniting pulses.

A common circuit arrangement for igniting a gaseous discharge lamp includes an inductive pulse generating circuit, including a voltage sensitive switch, and a timing circuit including a timing capacitor for determining how frequently the pulses are produced. It has been found that such circuit arrangements may produce AC currents through the switch which both increase stress on the switch and may adversely affect the operation of the timing circuit. In the case of a lamp which cannot be stably lighted, or one which requires many igniting pulses to be brought into a stable ignition state, such AC currents may affect rapid charging and/or discharging of the capacitor such that the timing circuit permits repeated pulse generation at a rate higher than can be tolerated by the switch.

In accordance with the invention, a circuit arrangement for igniting a gaseous discharge lamp comprises a timing circuit including a timing capacitor for limiting the rate of pulse production and an inductive pulse generating circuit including a unidirectional voltage-sensitive switch that is electrically connected in series with the capacitor. This arrangement unidirectionally limits the series current through the switch and the capacitor during each pulse.

DESCRIPTION OF THE PREFERRED EMBODIMENTS

Figure 1:
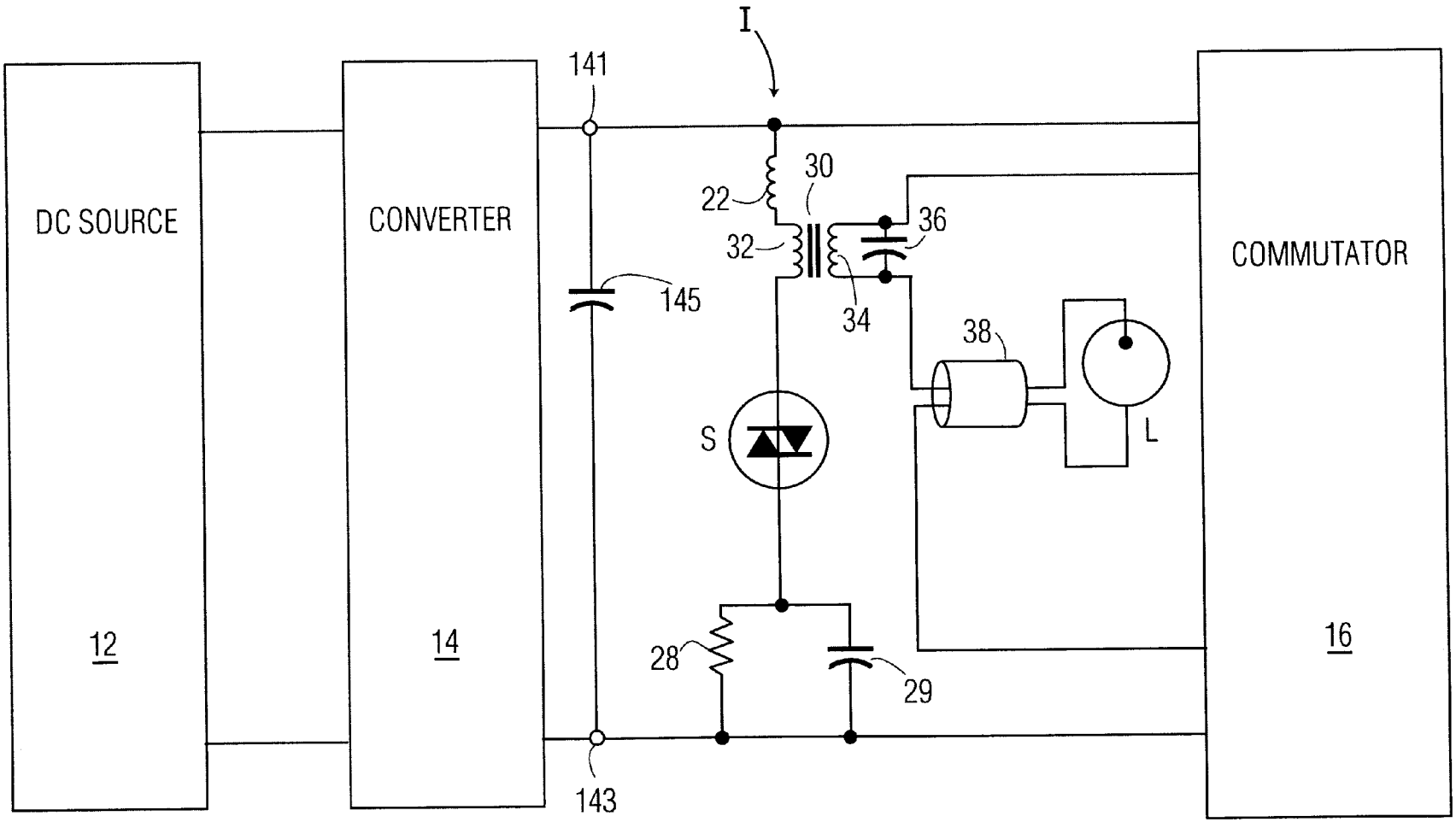
FIG. 1 PRIOR ART
FIG. 1 is a schematic drawing of a circuit arrangement over which the invention is an improvement.

FIG. 1 illustrates a ballast which is described in U.S. patent application Ser. No. 09/306,911 filed on May 7, 1999. Specifically, FIG. 1 shows a ballast including a source of DC power 12, a converter 14 having output terminals 141 and 143 between which an output capacitor 145 is connected, a commutator 16, and igniter circuitry I. The converter in this exemplary embodiment is a down converter which serves as a current source and applies to the commutator 16 and to the igniter circuitry I a voltage which is lower than that supplied by the DC source 12. The commutator 16 is provided for applying a periodically-reversing current, via a secondary winding 34 of a transformer 30, and via an electrical cable 38, to a gaseous discharge lamp L.

The igniter circuitry I includes, in addition to the secondary winding 34, an inductor 22, a primary winding 32, a sidac S, and a parallel combination of a resistor 28 and a capacitor 29, all electrically connected in series between the output terminals 141 and 143 of the converter 14. Preferably, as described in U.S. patent application Ser. No. 09/306,911 filed on May 7, 1999, which is hereby incorporated by reference, the transformer is one of a type which does not saturate at full lamp current (e.g. a gapped transformer) and a capacitor 36 is electrically connected across the secondary winding 34. This dampens ripple current delivered by the converter 14.

The inductor 22 protects the sidac by limiting the rate of change of current through it upon breakover. The capacitor 36 compensates for reduced coupling from the primary winding 32 to the secondary winding 34 when a gapped transformer is used. The capacitor 36 adjusts the resonance frequency of the secondary circuit of the transformer 30 and shapes the ignition pulses so that the ignition-pulse specification of the lamp L is met throughout the full range of load conditions for which the ballast is intended, including varying load capacitance as affected by length of the cable 38.

In operation, after power is applied by the DC source to the converter 14, internal switching circuitry (not shown) of the converter charges the output capacitor 145. The voltage across the sidac S is equal to the voltage across the capacitor 145. When this voltage reaches the breakover voltage of the sidac, the capacitor 145 discharges a current pulse through the primary winding 32, the sidac, and the parallel RC combination 28, 29, and effects production at the secondary winding 34 of a high voltage pulse. The current pulse ends when capacitor 29 charges to a voltage near that on capacitor 145 and, the current through the sidac becomes too low to keep it in conduction. Then the sidac switches OFF (i.e. into a non-conducting state) and capacitor 29 discharges through resistor 28.

If this first high-voltage pulse (transformed to a high-voltage pulse via the transformer 30) has ignited the lamp L, the lamp impedance drops to a low value, discharges the capacitor 145 to a voltage well below the breakover voltage of the sidac S, and the igniter circuitry will become inactive. However, the igniter circuitry will remain on standby and will immediately reactivate if the lamp extinguishes.

If the pulse does not ignite the lamp, the capacitor 29 will discharge through the resistor 28 until the voltage across the sidac again exceeds its breakover voltage and then the pulse-generating sequence will be repeated. The time constant of this RC timing circuit is made long enough to prevent breakover of the sidac more often than once per commutator period.

One of the benefits of the igniter circuitry I is its ability to rapidly restart a lamp which has extinguished. This is beneficial when power is momentarily lost, but has been found to sometimes overstress the sidac when the lamp is not stably started by the first pulse. In this situation, the igniter circuitry will repeatedly attempt to ignite the lamp and the sidac may fail.

Such failures are believed to result from two contributory factors. One factor is ringing current pulses which are generated by various resonances in the igniter circuitry and which pass through the sidac. Using the embodiment of FIG. 1 as an example, whenever the lamp L is not in an ignited state, the converter 14 charges the capacitor 145 until the breakover voltage of the sidac is reached. At this instant, the voltage across the sidac suddenly decreases to almost zero and substantially the full breakover voltage appears across the serial combination of the inductor 22 and the primary winding 32. The inductor 22 saturates easily so almost all of the voltage appears very quickly across the primary winding and is coupled, with a high step-up ratio (e.g. 15:1), to the secondary winding 34. The resultant high-voltage pulse produced by the secondary winding is applied across the lamp L by the commutator 16. During a portion of this pulse, current flows through a resonant circuit including the inductor 22, the primary winding 32, leakage inductance of the transformer 30, the sidac S, the capacitor 29 and, via coupling by the transformer, through the capacitor 36. This complex resonant circuit can be considered as including two portions—a primary resonant circuit dominated by the primary winding 32 and the capacitor 29, and a secondary resonant circuit dominated by the transformer leakage inductance and the capacitor 36.

Figure 2A:
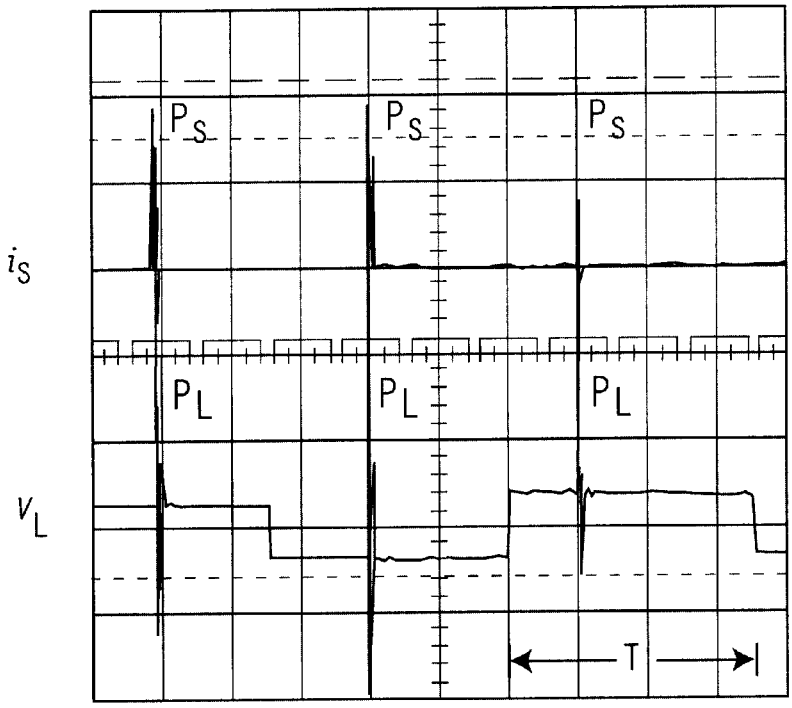
FIG. 2A PRIOR ART
FIGS. 2A, 2B and 2C illustrate waveforms occurring during operation of the circuit arrangement of FIG. 1.

FIG. 2A, drawn on a time scale of 1.0 millisecond/division illustrates first and second exemplary waveforms $i_S$ and $V_L$ produced simultaneously by the circuit arrangement of FIG. 1 during starting of a metal halide lamp. The waveform $i_S$ represents the current through the sidac S and shows three ringing current pulses $P_S$. The waveform $v_L$ represents the voltage across the lamp L and shows the alternate positive and negative voltages across the lamp L during three successive commutation periods, each having a duration T. The waveform $v_L$ also shows three ringing high-voltage pulses $P_L$, which are produced at the output of the transformer 30 and applied across the lamp as a result of the current pulses $P_s$ passing through the primary winding 32 of the transformer.

Figure 2B:
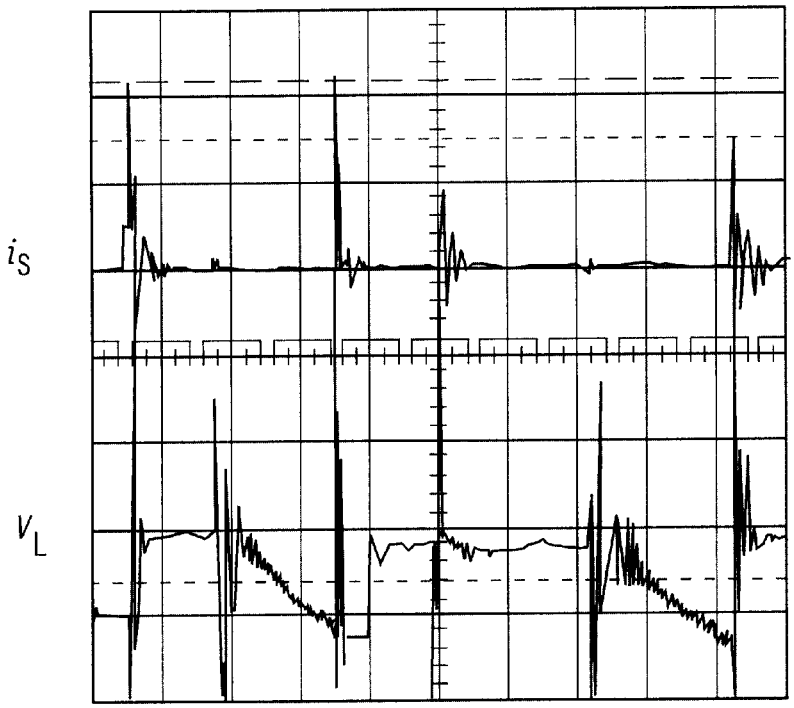
FIG. 2B PRIOR ART

Another contributing factor is the interaction of the RC timing circuit and the sidac when a lamp begins to ignite. The sudden decrease in the lamp impedance at this time not only discharges in the capacitor 145, but also may at least partially discharge the capacitor 29 before the sidac switches OFF. This decreases the delay produced by the RC timing circuit, depending on the degree to which such discharge occurs and the resulting voltage left on capacitor 29 when the sidac switches OFF. If the lamp begins to ignite, thereby discharging capacitor 29 to some degree, but then extinguishes, the sidac may breakover again with little or no delay. This is especially stressful on the sidac if the lamp repeatedly falls out of ignition before it is stably ignited or if it cannot be stably ignited (e.g. is defective or nearing its end of life). In such situations, the igniter circuitry might produce pulses at a rate which is much higher than that of the commutator. FIG. 2B, which is drawn on a time scale of 0.1 millisecond/division, illustrates an example of such multiple pulse production during a portion of a single commutator period.

Such a high rate of pulse production can cause the sidac to operate at power levels which exceed its specifications.

Figure 3:
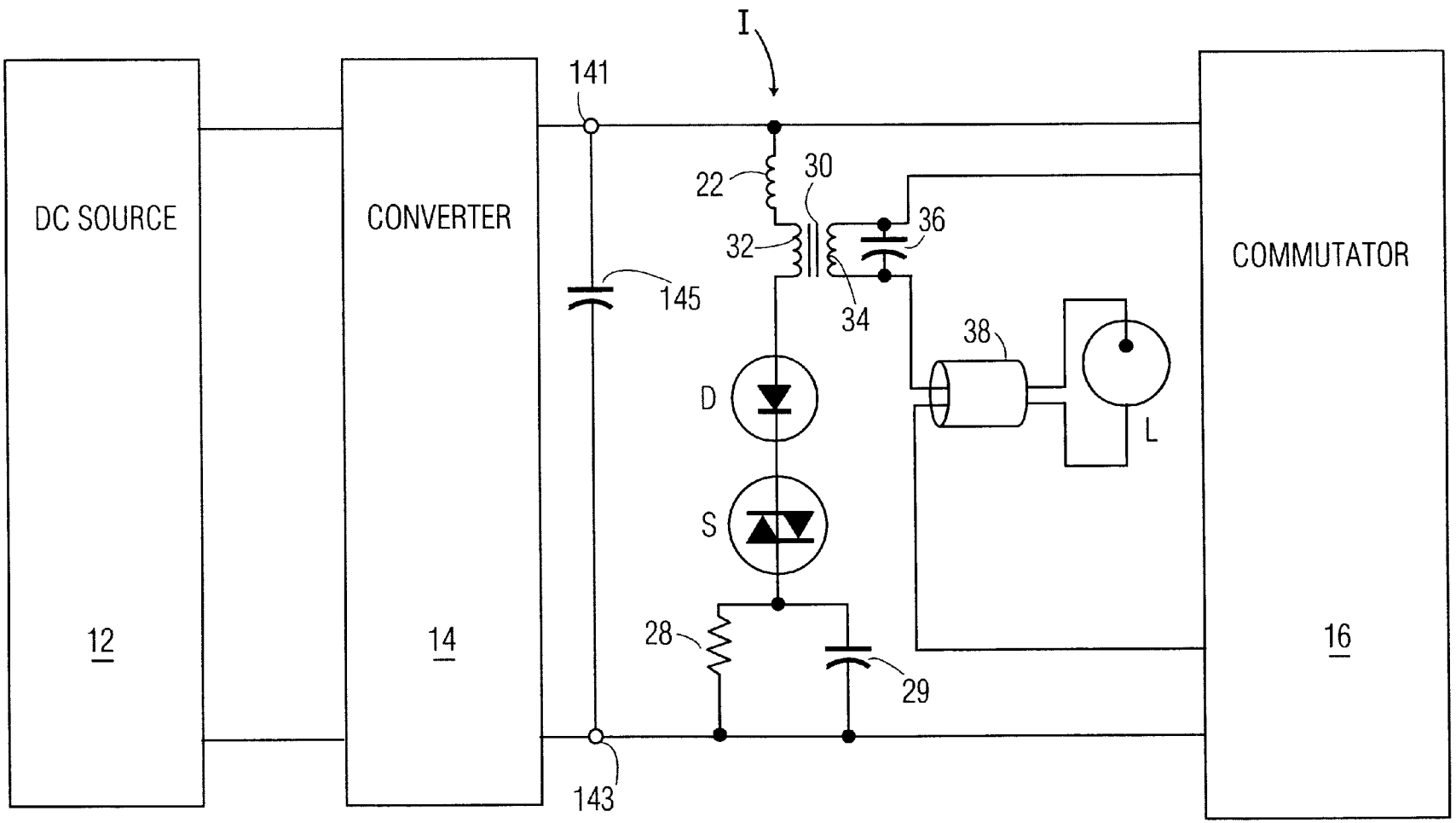
FIG. 3 is a schematic drawing of a circuit arrangement in accordance with a first embodiment of the invention.

In accordance with the invention, the igniter circuitry is modified to change the way in which the timing capacitor and the voltage-sensitive switch interact. Specifically, in the circuit arrangement of FIG. 1, a diode is electrically connected in series with the sidac 8, as shown in FIG. 3. Together, these two components form a unidirectional voltage-sensitive switch which permits current flow in only one direction. This prevents discharging of the capacitor 29 through the sidac. As a result, the capacitor 29 predictably charges to a positive voltage determined by the voltage on capacitor 145 and predictably limits the rate at which the sidac breaks over.

Figure 2C:
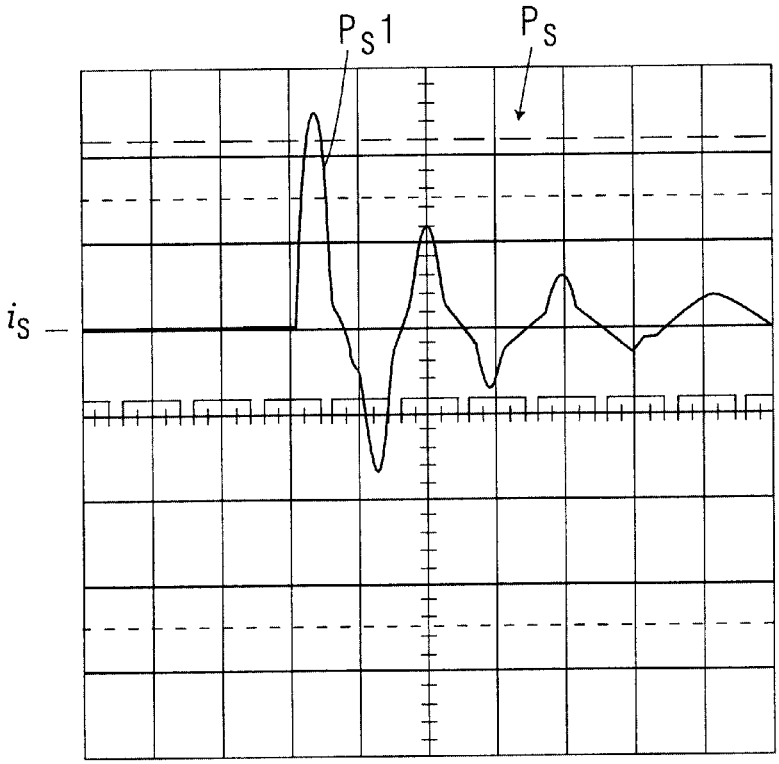
FIG. 2C PRIOR ART
Figure 2D:
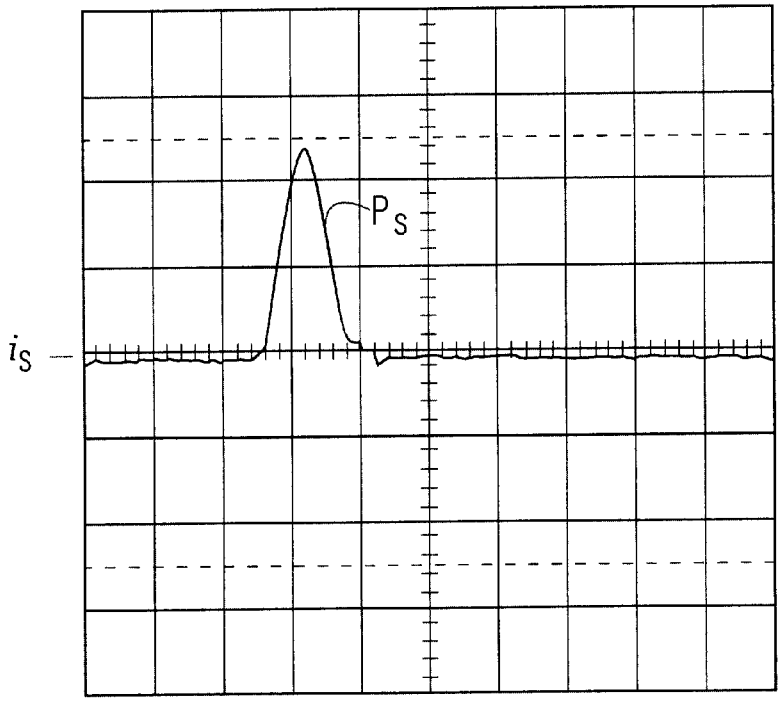
FIG. 2D illustrates a waveform occurring in a circuit arrangement in accordance with the invention.

The inclusion of the diode in series with the sidac and the RC timing circuit also eliminates the ringing. This is illustrated in FIGS. 2C and 2D. FIG. 2C, drawn on a time scale of 5.0 microseconds/division illustrates a single one of the ringing current pulses $P_S$ through the sidac of FIG. 1. By inserting the diode D, as shown in FIG. 3, only the first peak portion $P_S$ of each pulse passes through the sidac. FIG. 2D, drawn on a scale of 2 microseconds/division, shows an actual igniter current pulse $P_S$ through the diode D and sidac S during operation of the circuit arrangement of FIG. 3.

Thus, power dissipation in the sidac is reduced in two ways. First, the rate at which igniter current pulses pass through the sidac is predictably controlled by the capacitive timing circuit. Second, the energy dissipated during each current pulse is reduced from that of a multiple peak ringing pulse to that of just the first peak.

Figure 4:
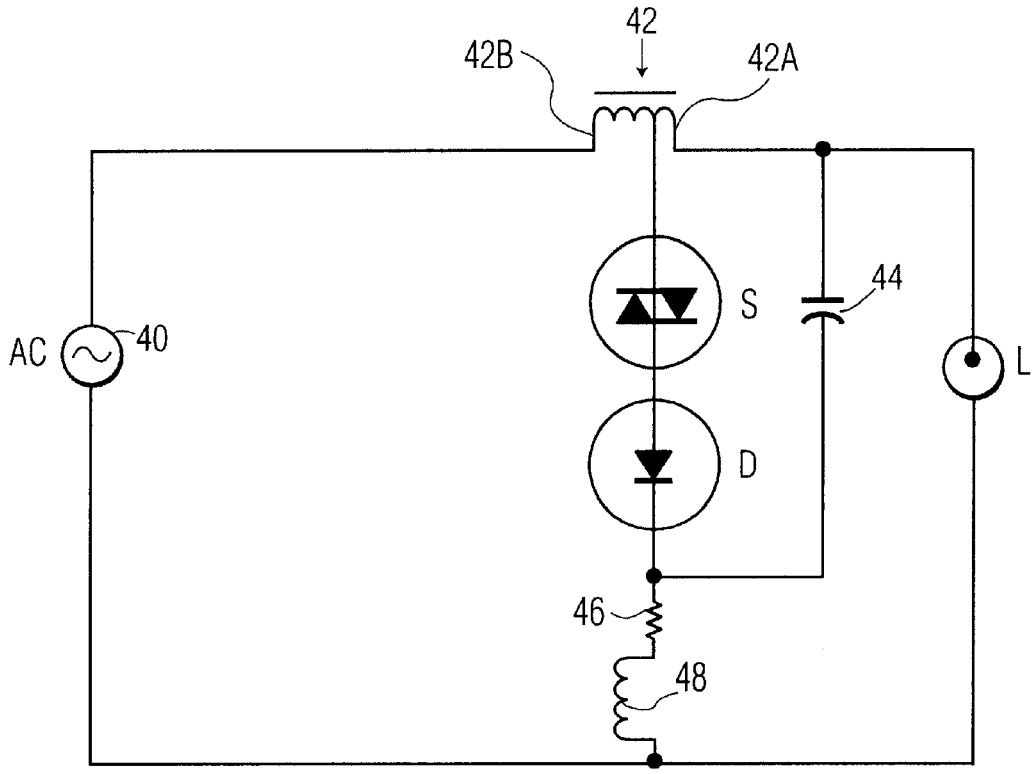
FIG. 4 is a schematic drawing of a circuit arrangement in accordance with a second embodiment of the invention.

The invention may be used advantageously with a variety of ballasts having pulse-type igniters. FIG. 4 shows an embodiment of a typical magnetic ballast which incorporates a unidirectional voltage-sensitive switch in series with a capacitive timing circuit in accordance with the invention. This ballast includes an AC source 40 and an autotransformer 42, having a primary winding 42A and a secondary winding 42B, electrically connected in series with a gaseous discharge lamp L.

The unidirectional voltage-sensitive switch, comprising a sidac S and a diode D, is electrically connected in series with a capacitor 44 and the primary winding 42A. A resistor 46 and an RF blocking coil 48 are electrically connected in series between a cathode terminal of the diode and a conductor which electrically connects the lamp L to the AC source 40.

In operation, during each positive cycle of AC power from the source 40, capacitor 44 charges through the path including the transformer 42, the resistor 46 and the coil 48. If the lamp has not yet ignited, capacitor 44 charges until its voltage exceeds the breakover threshold of the sidac S. The capacitor then rapidly discharges through the path including the primary winding 42A, the sidac S and the diode D, causing a high-voltage ignition pulse to be applied to the lamp L by the series combination of the AC source 40 and the transformer 42. When the current through the sidac S approaches zero, the sidac switches off and the capacitor voltage follows that of the AC source until it again exceeds the breakover voltage of the sidac. The resistor 46 forms a timing circuit with capacitor 44. The RC time constant of this circuit determines a phase shift in the charging voltage of the capacitor, relative to the phase of the AC power signal. Advantageously, this time constant is made such that the breakover voltage occurs near the peak voltage of the AC power and such that only one ignition pulse is produced per half cycle of the AC power. Similarly to the case of the FIG. 3 embodiment, the diode D prevents high-frequency ringing of the current pulse passing through the series circuit including the capacitor 44 and the sidac S. Otherwise, the instantaneous voltage on the capacitor when the lamp ignites (and turns off the sidac) could be unpredictable and could result in the same overstressing of the sidac.

Figure 5:
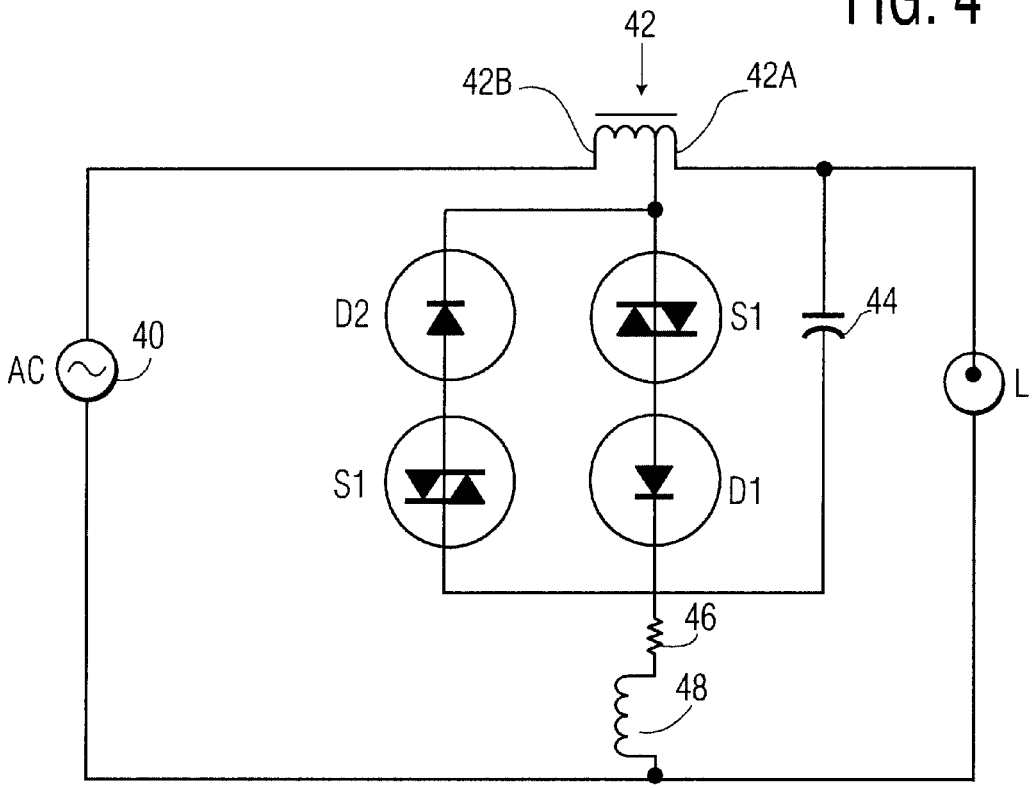
FIG. 5 is a schematic drawing of a circuit arrangement in accordance with a third embodiment of the invention.

The embodiment of FIG. 4 is capable of producing ignition pulses during only positive half cycles of the AC source voltage. FIG. 5 shows an embodiment which is capable of producing ignition pulses during both positive and negative half cycles. This ballast circuit arrangement is identical to that of FIG. 4, except for the inclusion of two oppositely-polarized unidirectional voltage-sensitive switches, which are electrically connected in parallel with each other but in opposite polarities. During positive half cycles, capacitor 44 discharges in one direction through a first switch comprising sidac S1 and diode D1. During negative half cycles, capacitor 44 discharges in the opposite direction through a second switch comprising sidac S2 and diode D2.

Figure 6:
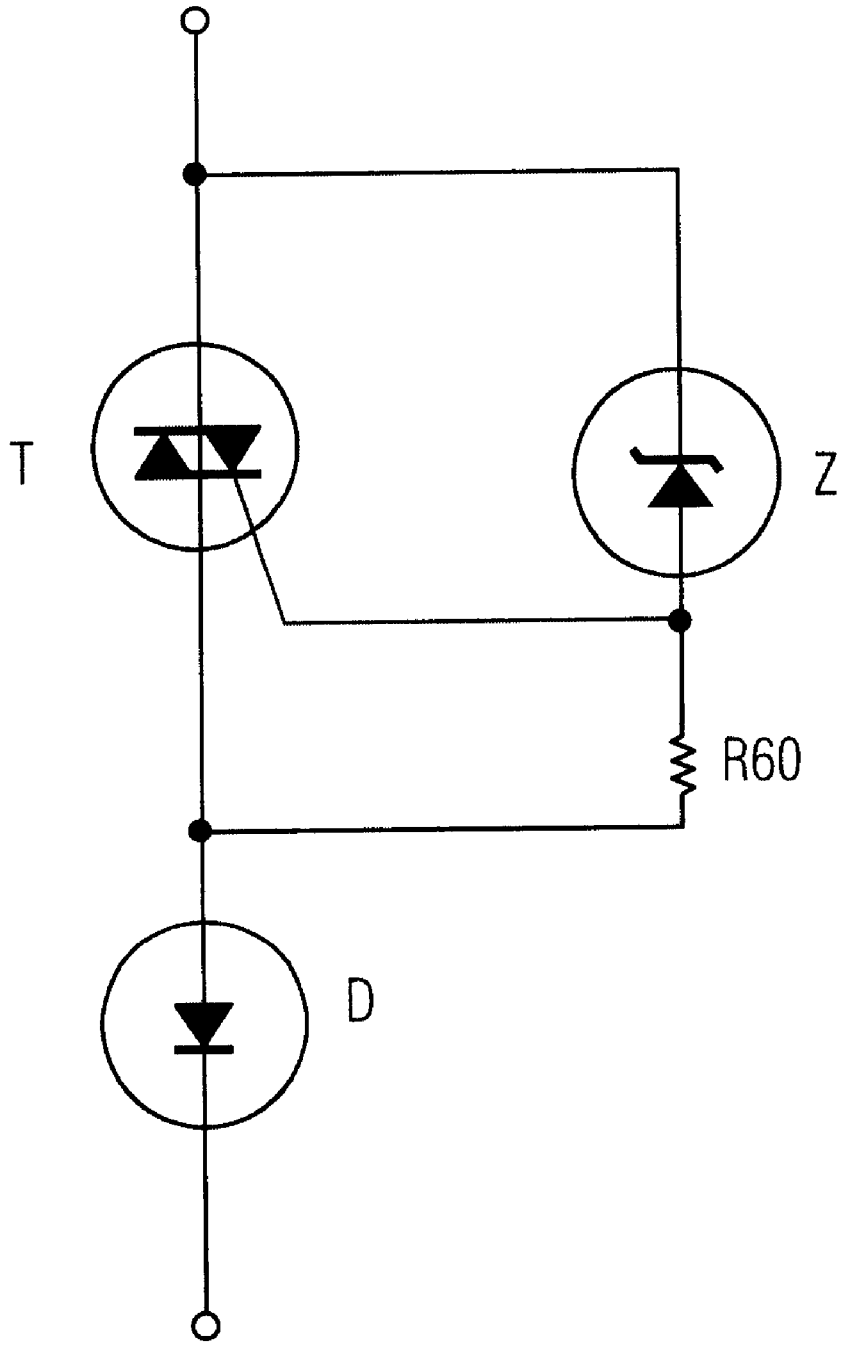
FIG. 6 is a schematic diagram of an alternative circuit element.

Note that, the invention is not limited to use with the specific exemplary circuit arrangements disclosed. Nor is it limited to use of the single type of unidirectional voltage-sensitive switch that is disclosed, i.e. a sidac in series with a diode. For example, one alternative configuration for such a switch is shown in FIG. 6. This switch includes a triac T electrically connected in series with a diode D and having a voltage-sensitive trigger circuit. The trigger circuit includes a Zener diode Z, electrically connected between a gate and a first terminal of the triac, and a resistor R60, electrically connected between the gate and a second terminal of the triac.

What is claimed is:

1. Igniter circuitry for a gaseous discharge lamp, said circuitry comprising:

a. a primary winding of a step-up transformer, said transformer being adapted for electrical connection to the lamp;

b. a pulse generator electrically connected to the transformer for producing a current pulse in the primary winding, said pulse generator including, electrically connected in series:

i) a timing capacitor; and ii) a unidirectional voltage-sensitive current switch for unidirectionally limiting the flow of current through the capacitor during the production of the current pulse.

2. Igniter circuitry as in claim 1 where the unidirectional voltage-sensitive current switch comprises a sidac electrically connected in series with a diode.

3. Igniter circuitry for a gaseous discharge lamp, said circuitry comprising:

a. a primary winding of a transformer;

b. a pulse generator electrically connected to the transformer for producing a current pulse in the primary winding, said pulse generator including, electrically connected in series:

i) a voltage-sensitive current switch;

ii) a timing circuit including a capacitor;

iii) a diode for unidirectionally limiting the flow of current through the capacitor during the production of the current pulse;

c. a secondary winding of the transformer for electrical connection to the lamp.

4. Igniter circuitry as in claim 3 where the voltage-sensitive current switch comprises a sidac electrically connected in series with a diode.

5. Igniter circuitry as in claim 3 where the timing circuit comprises an RC timing circuit.

6. Igniter circuitry as in claim 3 where the timing circuit comprises a resistor electrically connected in parallel with the capacitor.

7. Igniter circuitry as in claim 3 where the timing circuit comprises a resistor electrically connected in series with the capacitor.

8. Starting and operating circuitry for a gaseous discharge lamp, said circuitry comprising:

a. a source of DC power;

b. a commutator electrically connected to the lamp and to the source of DC power for powering said lamp with a periodically reversing polarity;

c. a primary winding of a transformer;

d. a pulse generator electrically connected to the transformer for producing a current pulse in the primary winding, said pulse generator including, electrically connected in series:

i) a voltage-sensitive current switch;

ii) a capacitive timing circuit;

iii) a diode for unidirectionally limiting the flow of charging current to the capacitive timing circuit;

e. a secondary winding of the transformer for electrical connection to the lamp.

9. A circuit arrangement for producing pulses for igniting a gaseous discharge lamp, said circuit arrangement comprising a timing circuit including a timing capacitor for limiting the rate at which said pulses are produced and an inductive pulse generating circuit including a unidirectional voltage-sensitive switch, said switch being electrically connected in series with the capacitor for unidirectionally limiting a common series current through the switch and the capacitor.

10. In a circuit arrangement for producing pulses for igniting a gaseous discharge lamp, said circuit arrangement comprising a timing circuit including a timing capacitor for limiting the rate at which said pulses are produced and an inductive pulse generating circuit including an alternating-current-conducting voltage-sensitive switch, the improvement comprising a diode electrically connected to the voltage-sensitive switch and to the timing capacitor for unidirectionally limiting a common series current through said switch and said capacitor.

* * * * *